United States Patent [19]

Kirby et al.

[11] 4,135,468

[45] Jan. 23, 1979

[54] BARGE-CARRYING WATERBORNE VESSEL AND TRANSPORTATION METHOD

[75] Inventors: William E. Kirby, Victoria, Hong Kong; David J. Seymour, Daly City, Calif.

[73] Assignee: Wharton Shipping Corporation, Edificio Vallarino, Panama

[21] Appl. No.: 775,936

[22] Filed: Mar. 9, 1977

Related U.S. Application Data

[63] Continuation-in-part of Ser. No. 701,696, Jul. 1, 1976, abandoned.

[30] Foreign Application Priority Data

| | | | |
|---|---|---|---|
| Jul. 13, 1976 | [IN] | India | 1259/76 |
| Jul. 8, 1976 | [PK] | Pakistan | 247/76 |
| Jul. 6, 1976 | [TW] | Taiwan | 6511386 |

[51] Int. Cl.[2] ..... B63B 35/40

[52] U.S. Cl. ..... 114/260

[58] Field of Search ..... 114/72, 73, 75, 85, 114/78, 121, 125, 260, 259; 214/15, 14 R

[56] References Cited

U.S. PATENT DOCUMENTS

| | | | |
|---|---|---|---|
| 1,107,741 | 8/1914 | Ballin et al. | 114/260 |
| 1,175,483 | 3/1916 | Steiner | 114/260 |
| 1,533,776 | 4/1925 | Tiburtius | 114/260 |
| 2,406,236 | 8/1946 | McDougall | 114/70 |
| 2,853,968 | 9/1958 | McLean | 114/72 |
| 3,247,822 | 4/1966 | Laskey et al. | 144/78 |
| 3,264,736 | 11/1971 | Iwami | 114/72 |
| 3,280,777 | 10/1966 | Matzer | 114/260 |
| 3,556,036 | 1/1971 | Wells | 114/72 |
| 3,774,565 | 11/1973 | Paxos | 114/260 |
| 3,939,760 | 2/1976 | Varges et al. | 114/260 |

FOREIGN PATENT DOCUMENTS

| | | | |
|---|---|---|---|
| 1930771 | 4/1971 | Fed. Rep. of Germany | 114/260 |
| 1170873 | 1/1959 | France | 114/72 |
| 1400750 | 11/1965 | France | 114/260 |

*Primary Examiner*—Trygve M. Blix
*Assistant Examiner*—Jesus D. Sotelo
*Attorney, Agent, or Firm*—Owen, Wickersham and Erickson

[57] ABSTRACT

A transportation method and barge-carrying waterborne vessel therefor having a hull with rigid supporting and hull-reinforcing structure, a bow, a stern, and side walls providing a series of buoyancy compartments. The hull has a hollow interior defining at least one hold extending most of the length of said vessel. The bottom of the hold is always below the level of the sea. Water can be placed from the sea into the hold and can be pumped out from it. A gate at one end of the vessel is opened for flotation loading of the hold, when the hold is partially flooded, with buoyant cargo carriers such as barges, lighters and pontoons. Each such carrier may be held down against the bottom of the hold. A collision bulkhead located adjacent the gate enables closing the hold off in a watertight manner, and this collision bulkhead can be opened to enable the flotation loading and unloading.

12 Claims, 22 Drawing Figures

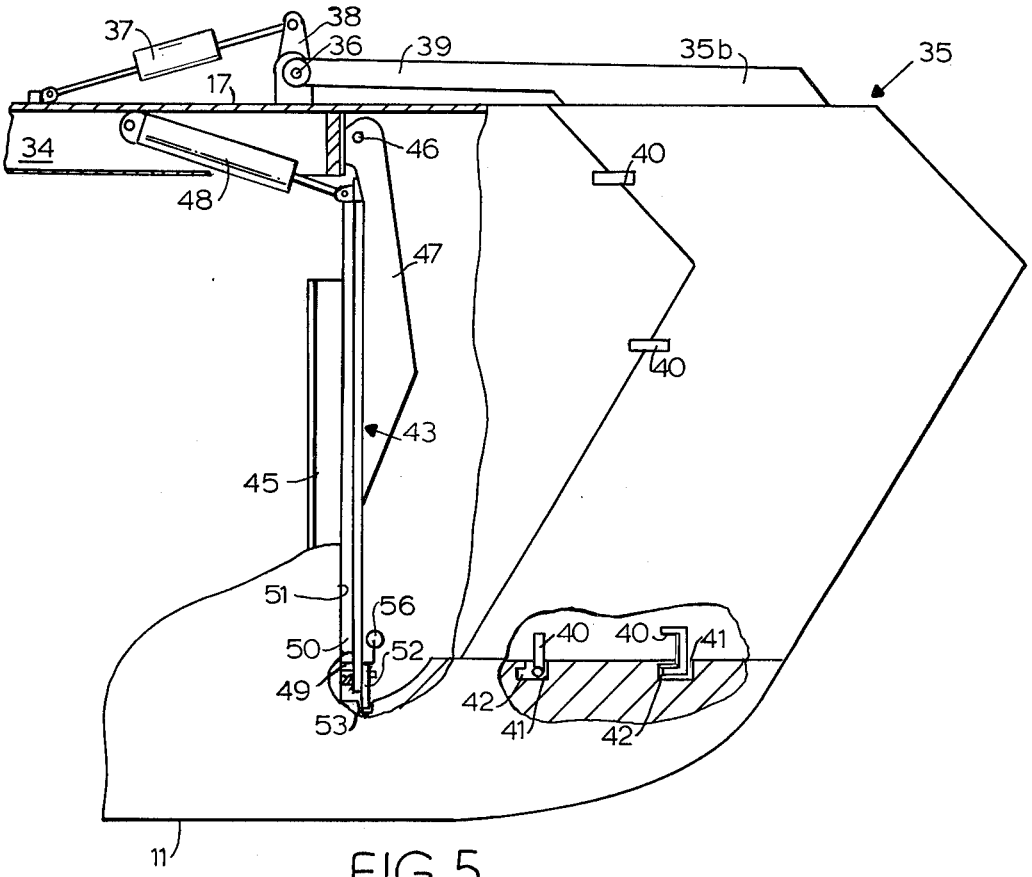
FIG. 5
FIG. 5A
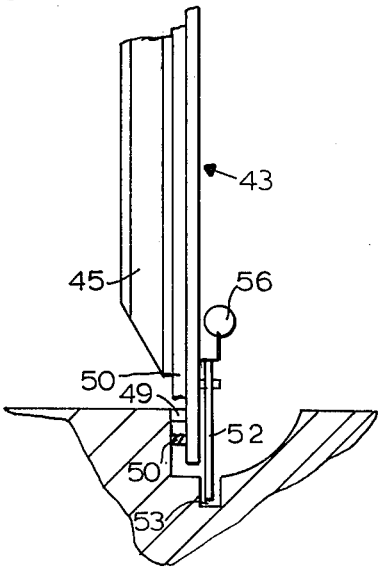
FIG. 9A
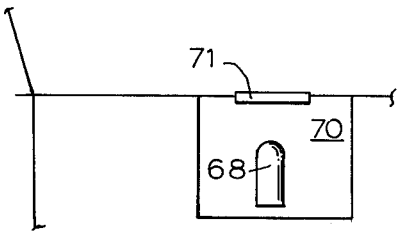

FIG. 13
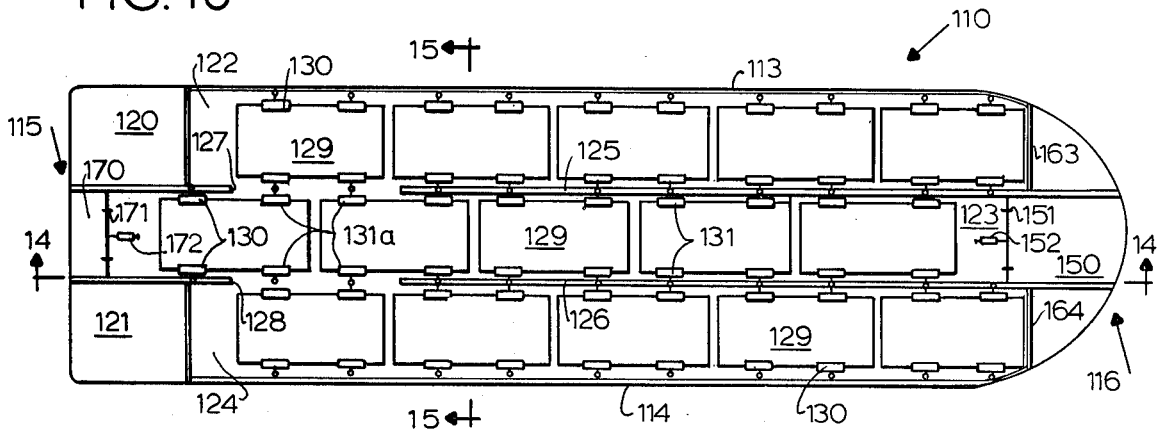
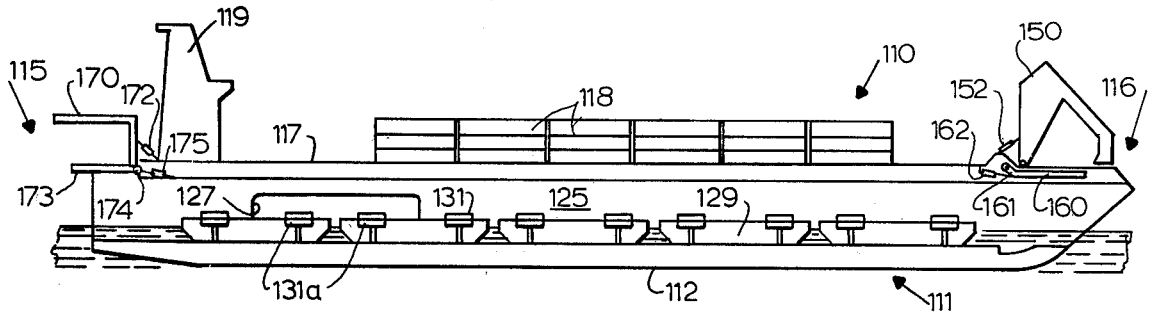
FIG. 14
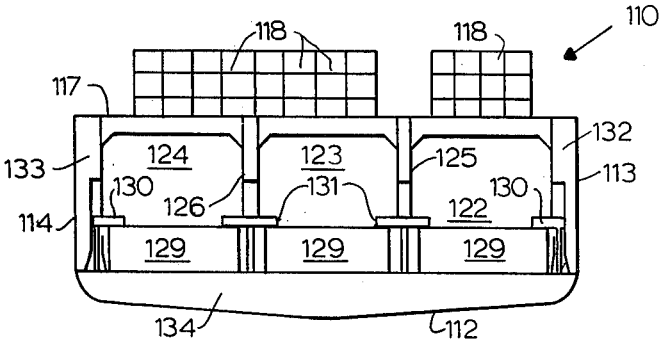
FIG. 15

FIG. 16
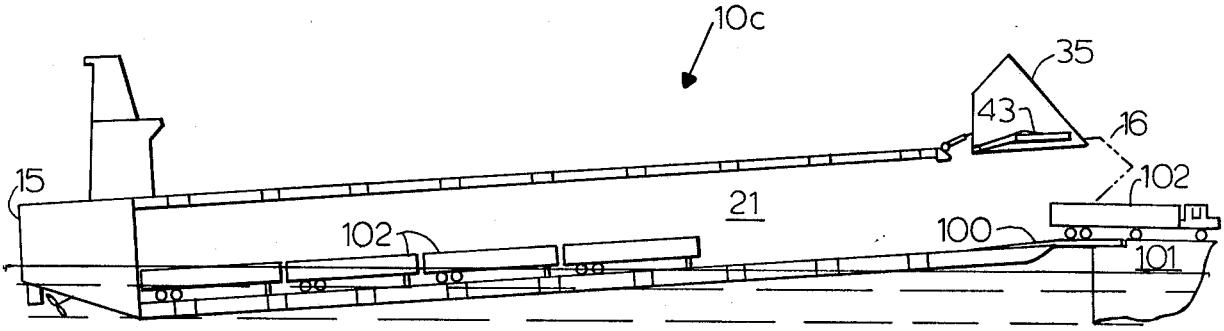
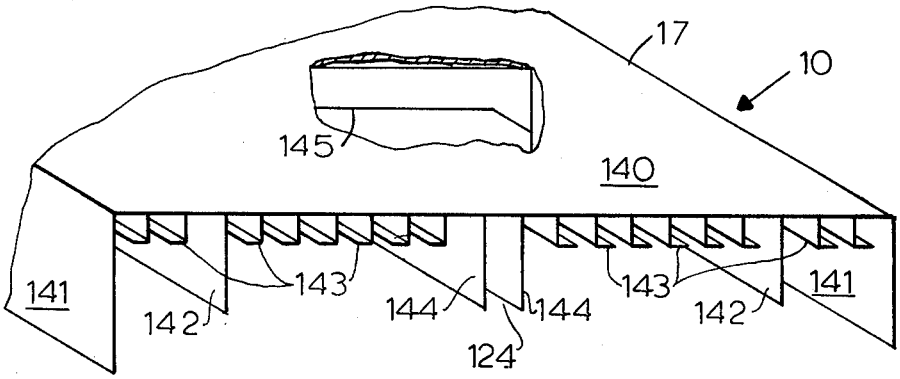
FIG. 17
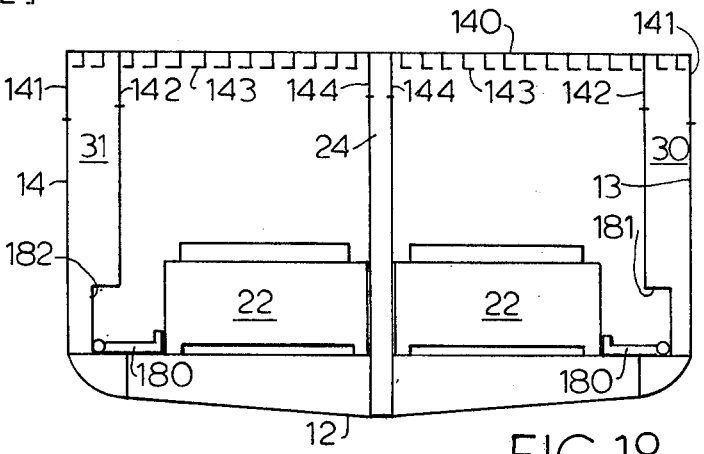
FIG. 18
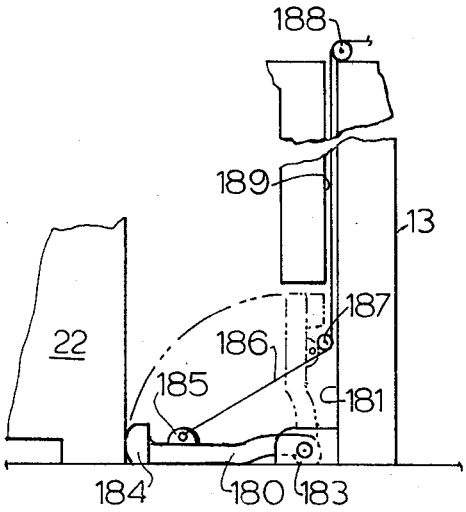
FIG. 19
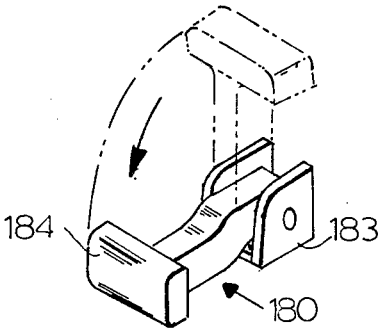
FIG. 20

BARGE-CARRYING WATERBORNE VESSEL AND TRANSPORTATION METHOD

REFERENCE TO RELATED APPLICATION

This application is a continuation-in-part of application Ser. No. 701,696, filed July 1, 1976, now abandoned.

BACKGROUND OF THE INVENTION

This invention relates to a barge-carrying waterborne vessel.

In our U.S. Pat. No. 3,913,512, issued Oct. 21, 1975, we described such a vessel of primary use in relatively shallow or coastal waters. In circumstances where a substantial width of ocean is to be crossed, as for example passage from New Orleans to the U.S.S.R., or from the Persian Gulf to San Francisco, or New York, some problems arise which require careful consideration. In high winds and storms at sea, considerable problems may arise from water inside the hold. Such water may tend to get into and fill barges or other containers, for in many instances these are not tightly enough sealed at their upper ends to prevent the entrance of such water, and in others their closures may be too weak to withstand it for long under difficult conditions. Therefore, while the vessel itself would be able to withstand the storms while carrying the barges and other containers, the barges themselves can be damaged or filled with water if not correctly adapted to such conditions, resulting in eventual damage to the cargo. Such problems might be solved by using barges having stronger and tighter closures, but the barges presently available cannot do so.

The present invention is directed to a solution of these problems.

In addition to the problems already mentioned, other problems arise when the vessel is to be used to carry a substantial load on deck in addition to the barges or other carriers inside the hold. In these instances the transportation of the barges may comprise a smaller fraction of the load than the cargo carried on deck or at least may not greatly exceed it. In such instances as these, it would be better to run the vessel dry, in order to accommodate the substantial dead weight cargo, for it is clear that a hull which is substantially open to the ocean can carry less dead weight than a vessel with a dry hold. At the same time, it is a great convenience to be able to load and unload by flotation of the cargo. However, there is an apparent difficulty in providing flotation loading and unloading and also enabling a vessel to carry a large dead weight; the vessel in our earlier patent is not able to do this on long ocean voyages.

The present invention also solves these problems by both providing flotation loading and unloading and also the ability to carry a substantial cargo dead weight.

The Present Invention's Approach to the Two Types of Problems Set Forth Above:

In the first instance where the main cargo comprises the floating containers, advantage can be taken of the features shown in U.S. Pat. No. 3,913,512 in which there is a transfer of buoyancy during the voyage between the less heavily loaded barges or containers and the carrying ship. In this type of situation the problem is that of meeting emergencies, such as storms at sea, high winds, etc. In overcoming this problem, the invention makes it possible to cut off the contact between the interior hold and the sea in which the vessel is floating and to pump the hold dry. The hold in this instance may be kept dry only long enough to make sure that the storm or other emergency conditions are ended.

The vessel shown in our U.S. Pat. No. 3,913,512 has hold-down devices enabling the transfer of buoyancy between the containers, such as barges, and the main vessel. These hold-downs can be used to prevent the floatable cargo from shifting when the hold is pumped dry, and they can be left in place to keep the barges and other floatable containers exactly in place at all times.

In solving the other problem discussed above, a somewhat different approach is taken, though there are similarities. In this instance, the hold is kept dry at all times except during loading and unloading of the barges by flotation. In other words, a short time before loading the hold is flooded and is kept flooded until the barges are aboard and in position and the hold-downs may then be actuated to put the barges in place and also to ensure that the water beneath them can be expelled more quickly than it could otherwise. Then the hold is sealed tight and pumped dry, usually before loading a major portion of the deadweight cargo on deck. The vessel makes its voyage in this instance with the hold dry, and then upon approaching port may first unload the deadweight cargo and then flotation unloading may take place.

During the changeover between drying out the hold and flooding (and the reverse) it is an important feature of this invention that the ballast tanks which comprise the major portion of the side walls of the vessel be balanced simultaneously, so that the change in effective ballast from a flooded hold to a dry one, and vice versa, is accommodated in the proper manner in the ballast tanks.

In the normally dry hold, the hold-down devices again may be used to keep the barges, etc., from shifting and they also perform an important safety function. If the vessel should leak seriously into the hold as by having severe damage to the hull, then there will be a transfer of buoyancy that will help the vessel to stay afloat better than it would if there were no such transfer.

However, when heavy barges are being transported, such hold-downs are not necessary, and when a variety of sizes of barges are to be mixed in the holds, the hold-downs tend to be impractical. Hence, hold-downs are not always necessary nor even desirable.

SUMMARY OF THE INVENTION

The vessel of this invention has a hull with rigid supporting and hull-reinforcing structure, a bow, a stern, and side walls providing a series of buoyancy compartments. A hollow interior defines at least one hold. The bottom of this hold is at all times below the level of the sea. A suitable system for flooding the hold with sea water may enable free passage of water into and out of the hold as a normal condition for some vessels, while in others this is done only during flotation loading or unloading of a plurality of buoyant cargo carriers such as barges, lighters and pontoons. These are introduced through a suitable gate at the bow or stern and, when they reach predetermined locations within the hold, cargo retaining hold-down means are, when desired, actuated for holding each carrier down on the bottom of the hold. When the hold is flooded, the carriers are partially supported by their own buoyancy. They are also so connected to the vessel as to enable exchange of buoyancy between the carrier and the vessel when the hold is flooded.

A hinged collision bulkhead may be used, either as emergency means for sealing the hold from the sea, in conjunction with preventing free passage of water into the hold, or as closed at all times except for shortly prior to or shortly after flotation loading and unloading. A suitable pumping system enables removal of the water from the hold.

A method of the invention comprises opening the gate and the collision bulkhead while there is water in the hold, floating a series of containers into the hold, and (when desired) forcing all the containers down against the bottom of the hold to hold them there in a stable position and also to force water from the hold out through the gate. Then the collision bulkhead is closed watertight to seal off the hold, and the gate is closed. Substantially all water is then pumped from the hold while adjusting the buoyancy of the vessel. Then, if desired, dry cargo may be loaded on the deck of the vessel. The voyage across the sea may be done with the hold dry or with it flooded, as desired. Upon arrival at a port, the dry cargo destined for the location may be unloaded, and then water from the sea may be sent into the hold, while adjusting the buoyancy of the vessel to place the water in said hold at approximately the same level as the sea. Then the gate and collision bulkhead are opened, and at least some of said containers are floated out. Then reloading can commence.

Other objects, advantages and features of the invention will appear from the following description of some preferred embodiments.

BRIEF DESCRIPTION OF THE DRAWINGS

In the drawings:

FIG. 5 is a detailed schematic view in side elevation with portions broken away and shown in section, of the bow of the ship, showing also the collision bulkhead.

FIG. 5A is an enlarged view of a portion of FIG. 5.

FIG. 9A is an enlarged fragmentary detail view in section taken along the line 9A—9A in FIG. 8.

FIG. 13 is a diagrammatic plan view of a modified form of ship embodying the principles of the invention having three longitudinal holds, a hinged bow gate and hinged collision bulkhead for opening the central hold for bow loading, and a stern gate for opening the central hold for stern loading or for through loading and unloading.

FIG. 14 is a schematic side view in elevation and section taken along the line 14—14 in FIG. 13.

FIG. 15 is an enlarged transverse view in section and elevation taken along the line 15—15 in FIG. 13.

FIG. 16 is a diagrammatic view in side elevation and vertical section of a ship embodying the principles of the present invention which has been ballasted for bow loading of roll-on, roll-off cargo container vehicles in the hold.

FIG. 17 is an isometric partial view of the midship section of deck structure of the ship of FIG. 1 with other portions of the ship broken off to save drawing space.

FIG. 18 is a view in elevation and midship section of a ship embodying the principles of the present invention in which barges are held in place against the centerline longitudinal bulkhead in the hold by lateral locking arms pivotable into place from recesses in the lower sidewalls of the ship.

Figure 1:
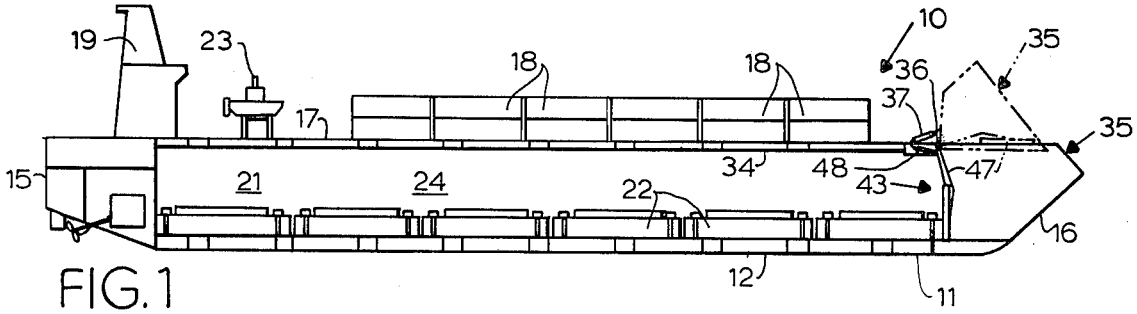
FIG. 1 is a diagrammatic view in side elevation and in section along the line 1—1 in FIG. 2, of a ship embodying the principles of the invention. The bow gate and collision bulkhead are shown in solid lines in their normal closed positions and in broken lines in the positions they assume when the barges are being loaded or unloaded. The barges are shown in the second position, i.e., within the hold of the ship, the hold being dry.

The FIG. 19 is an enlarged and somewhat diagrammatic view in vertical section and elevation of one of the locking arms shown in FIG. 18.

FIG. 20 is a diagrammatic perspective view of the locking arm shown in FIG. 19 with its stowed position and locus of movement illustrated with broken lines.

DESCRIPTION OF SOME PREFERRED EMBODIMENTS

The drawings are substantially diagrammatic, because the principles of the present invention are best illustrated thereby.

In FIGS. 1–6 are shown a ship 10 having a hull 11 with a bottom structure 12, a port side 13, a starboard side 14, a stern end 15, and a bow end 16. The ship 10 has a deck 17 which may be adapted to carry plural cargo containers 18, and also includes superstructure 19 providing a pilot house, crew quarters, galley, etc.

Figure 2:
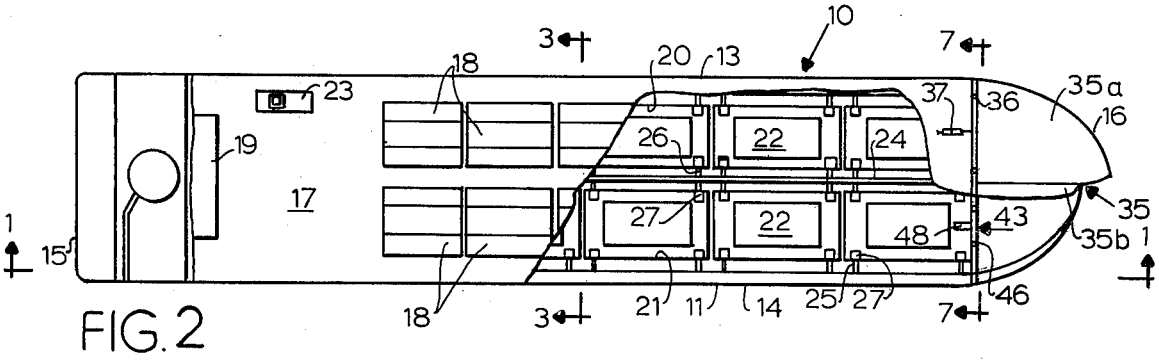
FIG. 2 is a plan view of the ship of FIG. 1 with a portion of the deck broken away to show the positioning of the barges in the two parallel holds of the ship.
Figure 4:
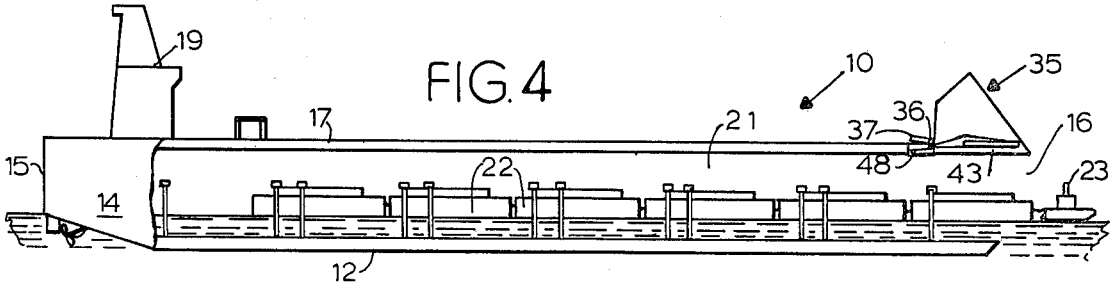
FIG. 4 is a view similar to FIG. 1 showing the bow gate and collision bulkhead in the open position and the vessel ballasted and configured for flotation loading and unloading of the barges.

Within the vessel 10 are two parallel holds, a port hold 20, and a starboard hold 21, which are provided to receive by flotation loading a series of buoyant cargo carriers 22, such as barges, lighters and/or pontoons. As in our U.S. Pat. No. 3,913,512, there is an openable gate assembly in at least one end of the ship 10, and if desired at both ends. Thus, either the bow 16 or the stern 15, or both of them, may be fitted with gates for moving the cargo 22 into and out from the holds 20 and 21. A flotation unloading operation is illustrated in FIG. 4 where a small but powerful barge tender 23 is shown towing a tandem series of buoyant cargo carriers 22 out from the starboard hold 20 of the vessel 10. The tender 23 may be associated with the port, or it may be carried aboard the ship 10, as illustrated in FIGS. 1 and 2. The bottom of each hold 20, 21 is below the waterline of the ship 10 at all times.

In the form of the invention shown in FIGS. 1–5, the holds 20 and 21 are separated by a longitudinal bulkhead 24. There may be no such bulkhead, as where there is a single hold, or there may be more than two holds, depending on the size and number of the cargo carriers 22 to be carried in the hold as well as the beam of the ship 10, etc.

Figure 3:
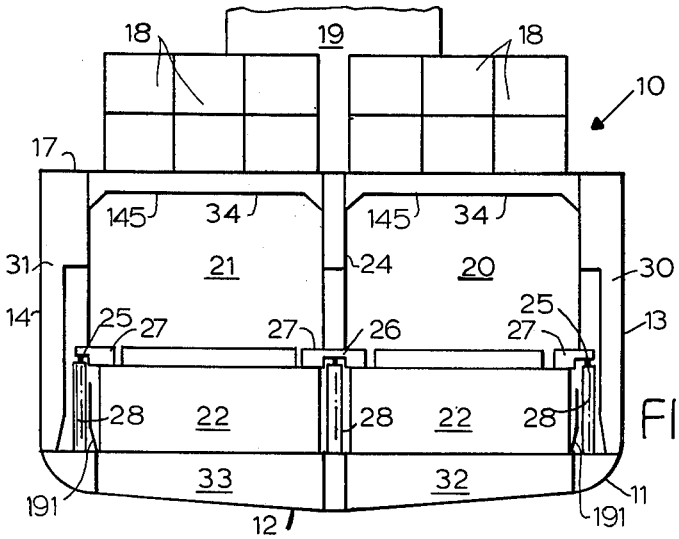
FIG. 3 is an enlarged view in section taken along the line 3—3 in FIG. 2.
Figure 11:
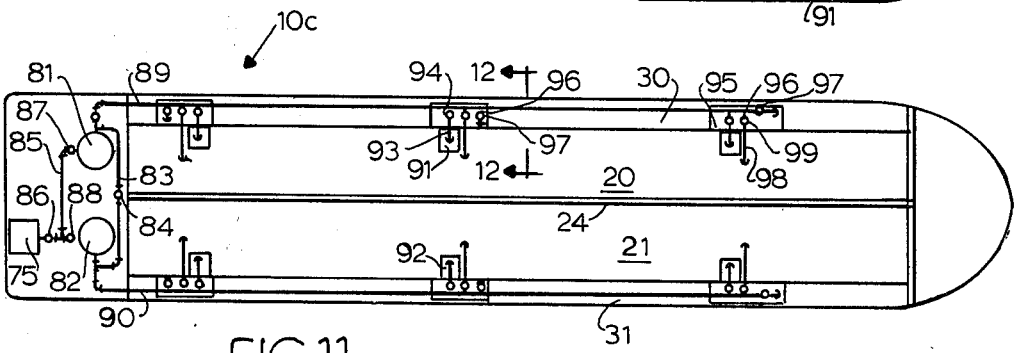
FIG. 11 is another plan view similar to FIG. 8, which illustrates the use of the ship's ballasting system for the purpose of flooding and dewatering a normally dry hold, which is loaded and unloaded by flooding and flotation of cargo carriers.

In one form of the vessel of the present invention, single-type carrier-hold-down devices 25 may, if desired, be mounted within the port and starboard side wall structures 13 and 14 at spaced apart locations throughout the length of the holds 20 and 21. Dual-type hold-down devices 26 may be included within the central longitudinal bulkhead 24. As shown in FIGS. 3 and 11, the hold-down devices 25 and 26, when used, are sized and spaced to engage mating receptacles generally located at or near the corners of buoyant cargo carriers 22. When the vessel 10 is loaded with conventional flat bottomed river barges, the hold down devices 25 and 26 (if used at all) have elongated clamping members 27 for contacting substantial lengths of the side walls of such barges, in order to distribute evenly the forces induced by the action of the hold-down devices. Such members 27 are illustrated and described in our co-pending U.S. Application Ser. No. 583,439.

The hold-down devices 25 and 26 are typically powered by hydraulic cylinders 28 mounted in the side walls 13 and 14 and central bulkhead 24 and are described in our co-pending U.S. Application Ser. No. 678,623. As will be explained hereinafter, the hold-down devices 25 and 26 may be used in conjunction with pumps (described later) to purge the holds 20 and 21 of sea water, after the carriers 22 have been loaded and before the holds 20 and 21 are closed.

The port side wall 13 includes (See FIG. 3) structure forming a series of port ballast tanks 30, and the starboard side wall structure 14 similarly provides a series of starboard tanks 31. The bottom structure 12 includes therein port hold-ballast tanks 32 below the port hold 20 and starboard hold-ballast tanks 33 beneath the starboard hold 21. Deck support structure 34 extends between the port and the starboard sides 13 and 14 and the longitudinal bulkhead 24. The structure 34 not only supports the deck 17, it carries and distributes the weight of the deck container cargo 18. The deck structure 34 is one of the distinctive features of the vessels 10, and is described in greater detail hereinafter in connection with FIG. 17.

The ship 10, as shown in FIGS. 1–7, is provided with a bow gate assembly 35 comprising two sections, a port section 35*a* and a starboard section 35*b* (See FIG. 2), each of which is hinged to the deck 17 by hinges 36 so that it swings upwardly to the position shown in FIG. 4. As illustrated in FIG. 5 hydraulic actuators 37 are each preferably mounted on the deck 17 to turn a bell crank 38 that rotates a hinged supporting member 39, to move the bow gates 35*a* and 35*b* up and down. These bow gates 35*a* and 35*b* need not be watertight in the closed position although they preferably do not admit a great flow of water. However, there need be no special gaskets or any special provisions taken to assure complete watertightness of the bow gate assembly 35.

To lock the bow gates in the closed position, the gates 35*a* and 35*b* are provided with several locking dogs 40 which are actuated by powering devices, such as hydraulic cylinders (not shown). The locking dogs 40 are spaced apart along the edges of the gate 35 and the adjacent fixed structure of the vessel 10. In order to retain the bow gate assembly 35 securely in place during ocean operations, it is necessary for the locking dogs 40 to lock not only against horizontal forces but also against vertical forces induced by the sea as the vessel 10 pitches bow down. Consequently, the dogs 40 preferably enter L-shaped receptacles 41 and then rotate axially to lock against a locking indentation 42 of each receptacle 41. The locking dogs 40 are preferably secured to the bow gates 35*a* and 35*b* rather than to the bottom structure 12 of the vessel 10 so that the dogs 40 are accessible for servicing by raising either gate 35*a* or 35*b*.

An important feature of the present invention is an upwardly swingable, hinged, collision bulkhead system 43 located aft of the bow gate assembly 35 at about the normal location for collision bulkheads typically required in oceangoing vessels. As with conventional, fixed, collision bulkheads the present hinged bulkhead system 43 provides a reinforced closure at the bow of the vessel 10 and functions to safeguard the watertightness and structural integrity of the vessel 10 in the event it collides with another ship or object.

The particular collision bulkhead system 43 of the present invention is unusual in that it retracts upwardly to a position above the height of the overhead structure of the holds 20 and 21 after the bow gate assembly 35 is raised, to enable flotation loading of cargo carriers 22 into the holds 20 and 21 without obstruction. The bulkhead construction is massive, typically being three to four feet in thickness, and constitutes a substantial weight. Consequently, in vessels such as the vessel 10 having dual holds, the bulkhead system 43 is preferably constructed in two sections, a port hold closure section 44 and a starboard hold closure section 45. The number of such sections preferably corresponds to the number of longitudinal holds of the particular vessel (e.g. three sections in the vessel of FIGS. 13–15).

The collision bulkhead 44 and 45 need not extend the full height from the bottom of the holds 20 and 21 to the deck supporting structure 34. Preferably the bulkheads 44 and 45 are somewhat shorter so as to minimize materials and to reduce the weight that would otherwise have to be supported. They are made sufficiently high to accomplish the purpose of effecting a watertight closure for the holds 20 and 21, and they extend substantially above the fully laden waterline of the vessel 10.

Hinges 46 and support arms 47 join the bulkheads 44 and 45 to the deck supporting structure 34. Hydraulic rams 48 are positioned between the deck structure 34 and the arms 47 to push each of the bulkheads 44 and 45 upwardly into the retracted open-hold position.

After the unloading and loading of the vessel 10 is complete, the hinged collision bulkheads 44 and 45 are lowered to the closed position, shown by the position of the starboard bulkhead 45 in FIGS. 5 and 5A. The bulkheads 44 and 45 come to rest against stops 49, which are mounted in and project from the bottom structure 12 of the vessel 10. Secured about three sides of the periphery of the hold side of each collision bulkhead 44 and 45 is a continuous U-shaped gasket 50, which provides the required watertight seal for the holds 20 and 21. The gasket 50 may be made of neoprene, or it may be a pneumatically or hydraulically inflated elastomeric tube. In any event, the stops 49 function to hold the collision bulkhead 45 a spaced distance away from a smooth sealing surface 51 of a transverse rib structure of the vessel 10 so that while a sealing engagement is achieved between each bulkhead 44 or 45 and the sealing surface 41, the gasket 50 is not unduly crushed or deformed in the closed position. The gasket 50 is preferably secured to the hinged collision bulkheads 44 and 45 to minimize the possibility of damage during loading or unloading operations, and to provide ready access for repairs or replacement in the open position.

Figure 6:
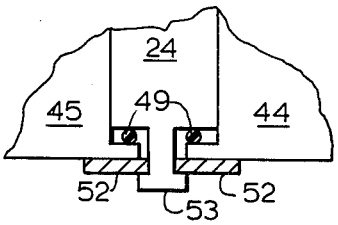
FIG. 6 is a detail plan view of the locking mechanisms of the port and starboard hinged collision bulkheads at the longitudinal bulkhead.

The hinged bulkheads 44 and 45 are provided around its lower and outer peripheral edges with at least one series of linked locking dogs 52 (see FIGS. 5 and 6). More dogs 52 are usually provided for the collision bulkheads 44 and 45 than are provided for the hinged bow gates 35*a* and 35*b* because of the requirement that the bulkheads 44 and 45 achieve a watertight seal. The dogs 52, which are spaced along the lower periphery of the bulkhead 45, may lock into a groove 53 in the bottom structure 12. Channeled locking bars 54 are preferably provided for engagement by the peripheral locking dogs 52 on the side edges of the bulkheads 44 and 45. The locking bars 54 are secured to the smooth surface 51 at the port and starboard sides 13 and 14 and at the longitudinal bulkhead 24. The dogs 52 are linked together by at least one linking bar 55, which is, in turn, driven by at least one hydraulic actuating cylinder 56. Three linking bars 55 and three driving cylinders 56 are provided for locking each bulkhead 44, 45 in the closed positions, shown as the position of the starboard bulkhead 45 in FIG. 7. As with the bow gate assembly 35, the moving portion of the locking mechanism is preferably mounted on the hinged collision bulkhead 45 so that it may be accessible by partially lifting the bulkhead 45 to the position shown in FIG. 7. Thus, it will be appreciated that the present invention, in addition to having a bow gate, also provides a hinged collision bulkhead which acts not only to protect against the contingency of a collision but also to seal the hold in a watertight condition when and if it is desired to operate the vessel 10 with dry holds.

In vessels having multiple longitudinal holds, such as the vessel 10 shown in FIGS. 1–7, it is preferable to provide each hold with a separately sealing hinged bulkhead so that each hold may be separately loaded or unloaded, and so that during operation of the vessel, one hold can be flooded and achieve transfer of buoyancy with locked-down cargo carriers or barges therein and the other hold can be dried to carry cargoes or cargo carriers unsuited to the condition of a flooded hold.

Vessels constructed in accordance with the present invention may be configured either for operation normally with all holds flooded, to utilize the transfer of buoyancy principle described in our U.S. Pat. No. 3,913,512, or with some flooded and some dry, or with all holds dry. In any event, in accordance with the present invention, the vessel is provided with at least one pump 60 for removing water from the holds 20 and 21.

Figure 8:
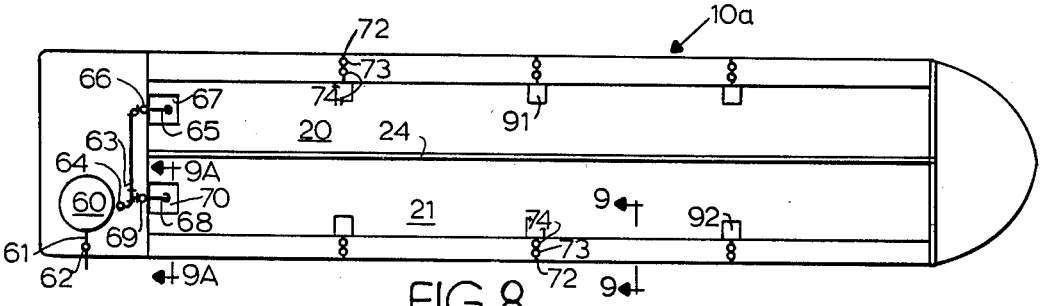
FIG. 8 is a diagrammatic plan view of the ship of FIGS. 1 and 2 showing one system for transferring water into and out of the hold, as used in ships where normally the hold is flooded.

As shown schematically in FIG. 8, the pump 60 is connected between an overboard discharge conduit 61 having a valve 62 and suction piping 63 having a valve 64 at the pump 60. The suction piping 63 includes two branches, a port-hold branch 65 having a valve 66 and an end located in a sump 67 in the port hold 20, and a starboard-hold branch 68 having a valve 69 and a collecting end in a sump 70 located in the starboard hold 21.

Figure 9:
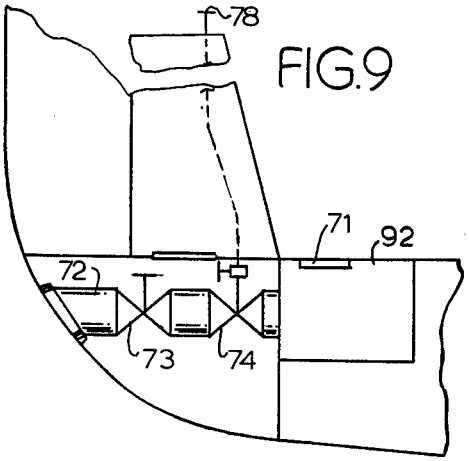
FIG. 9 is an enlarged fragmentary detail view in section taken along the line 9—9 in FIG. 8.

A vessel 10*a* as illustrated in FIG. 8 is designed primarily for use with its holds 20 and 21 normally flooded, dewatering of the holds being practiced only in the event of emergencies or upon encountering extremely rough seas. In order to make the operation of the vessel 10*a* simple and economical, e.g., three flood pipes 72 (FIGS. 8 and 9) are provided below the waterline on each side of the ship 10*a* to enable flooding of the holds 20 and 21. Each flood pipe 72 is provided with two valves, a manual valve 73 and a remotely actuated mechanical, hydraulic or electric valve 74. At least with the remotely actuated valves 74, special provisions are made to provide for their operation from the deck. For this purpose the deck 17 is provided with suitable recesses or closed members to enable a handle, hydraulic, or electric controls 78 (FIG. 9) to extend from the valves 74 up to the deck 17 and to be operated there and perhaps at other locations on the vessel 10*a*.

In the type of ship 10*a* illustrated in FIG. 8, the holds 20 and 21 will be normally flooded, and the valves 73 and 74 will normally be open. In the event of emergencies or rough seas, the valves 73 and 74 are closed tightly in every flood pipe 72, and then the holds 20 and 21 are pumped dry by means of the pump 60. Water is sucked from the sumps 67 and 68 through the suction piping 63 by the pump 60 and thence discharged overboard via the overboard discharge conduit 61. In this particular instance the pump 60 is a special unit having a capacity enabling dewatering of the holds 20 and 21 fairly rapidly. It is not the pump utilized for normal ballasting of the ship.

As shown in FIG. 9A, each of the sumps 67 and 70 is provided with a suitable strainer 71 to obstruct the passage of potentially damaging articles through the conduit 63 and the pump 60.

Figure 10:
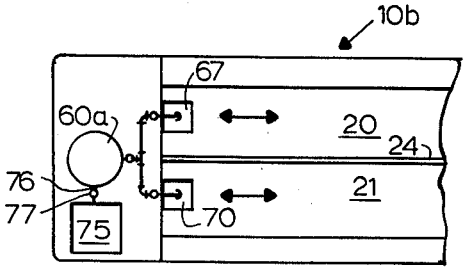
FIG. 10 is a fragmentary plan view of a ship similar to the ship shown in FIG. 8, in which the hold is normally dry, except during loading and unloading, illustrating an alternate system for watering and dewatering the hold.

As shown in FIG. 10, a ship 10*b* may be outfitted for operation with normally dry holds in accordance with the present invention. In this instance, the flood pipes 72 and associated machinery are dispensed with, and a pump 60*a* communicates with a sea chest 75 via a conduit 76 having a valve 77. In this case, the holds 20 and 21 are flooded by water passing from the sea chest 75 through the pump 60*a* and into the holds 20 and 21 via the sumps 67 and 70. To dewater the holds, the operation is reversed, and the pumps 60*a* suck the water from the holds 20 and 21 through the sumps 67 and 70 and discharge it into the sea chest 75. In both the normally-wet-hold configuration of the vessel 10*a* and the normally-dry-hold configuration of the vessel 10*b*, the pump 60 or 60*a* is capable of flooding and dewatering the holds 20 and 21 in a relatively short period of time.

As will be readily appreciated by those skilled in the art the provision of a pump capable of dewatering the holds in one half-hour requires inclusion of large, expensive machinery, which may be additional to existing pumping systems in the vessel. Accordingly, it is an alternative feature of the present invention to enable the use of existing ship ballast pumps, so long as they are provided with somewhat greater capacity than otherwise.

Figure 12:
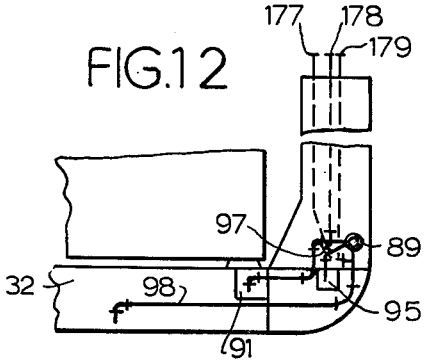
FIG. 12 is an enlarged schematic view in section taken along the line 12—12 in FIG. 11.

A vessel 10c, illustrated in FIGS. 11 and 12, includes a port pump 81 mechanically linked to the port engine (not shown) and a starboard pump 82 similary mechanically linked to the starboard engine (also not shown). A bypass pipe 83 having a valve 84 is connected across the pumps 81 and 82, so that either pump 81 or 82 may function in the system of the vessel 10c in the event that the other is disabled or undergoing repairs. In this particular example, the pumps 81 and 82 pump from and to a sea chest 75 via piping 85 having suitable valves 86, 87 and 88.

A longitudinal header pipe 89 extends substantially the whole length of the port side wall 13, and a similar longitudinal starboard header pipe 90 extends the length of the starboard side wall 14. Spaced apart over the length of the port header pipe 89 are drainage sumps 91 provided with strainers 71. Starboard drainage sumps 92 are likewise positioned along the length of the starboard header pipe 90. In each sump 91 or 92 is located a conduit 93, which is connected to the header pipe 89 or 90 through a valve 94. Another series of sumps 95 is provided in the port and starboard ballast tanks 27 and 29. A ballast pipe 96 within each sump 95 is joined to the header 89 or 90 through another control valve 97. Finally, a bottom ballast pipe 98 extends into each port hold and starboard hold bottom ballast tank 32 and 33. The pipe 98 is also connected to either the port header 89 or the starboard header 90, depending upon the location of the ballast tank served. A control valve 99 is placed in each pipe 98. The valves 94, 97, and 99 are preferably remotely actuated from the deck or from the engine room either by mechanical linkages or by pneumatic, hydraulic or electric controls 177, 178, and 179.

With the configuration of the vessel 10c, it may take longer to flood the ship and to pump it dry than is required by the special pump 60 used in the vessels 10a and 10b. Because of the multiple valves involved, the vessel 10c may be provided with automatic machinery for regulating the adjustment and actuation of the valves 94, 97 and 99 to maintain the proper trim of the vessel 10c during flooding and dewatering of the holds 20 and 21 and simultaneous ballasting thereof. Specific mechanisms for effecting the automatic control of the valves 94, 97, and 99 of the vessel 10c are well known in the art. Accordingly, details of such mechanism are omitted to avoid obscuring the principles of the present invention.

The loading and unloading operation of the vessel 10c will now be described. This explanation begins at the completion of the sea voyage of the vessel 10c wherein the cargo containers 22 are locked in place in the holds 20 and 21 by the hold-down devices 25 and 26. The holds 20 and 21 have been purged of water during the voyage and are in a dry state. In some cases (as with a variety of barges as the cargo), no hold-down devices 25, 26 will be used, and they may be absent from the structure where heavy barge transportation is the sole use of the ship. Flat-bottom barges have a high coefficient of friction with the hold that is sufficient to hold them in place.

The first operation is to ballast the ship 10c to a loading and unloading draft by operation of, e.g., the ballasting pumps 81 and 82 shown in FIG. 11. The ballast tanks 30, 31, 32, and 33 commence filling with seawater pumped from the sea chest 75 through the header pipe 89 and 90 into the tanks in accordance with the settings of the valves 97 and 99 along the lengths of the pipes 89 and 90. Simultaneously, water is passed into the holds 20 and 21 through the hold sumps 91 and 92 via the valves 94. The vessel 10c thereupon submerges to a new waterline position appropriate to the flotation loading and unloading of the cargo carriers 22 in the holds 20 and 21.

At this point, the bow gate locking dogs 40 are retracted from their receptacles 41, and one or both of the bow gates 35a, 35b are raised to the open position by actuation of one or all of the bow gate cylinders 37.

The hinged collision bulkheads 44 and 45 may then be opened by release of the locking dogs 52. The dogs 52 are released by appropriate actuation of the hydraulic cylinders 56 on the door to be opened. Then the hydraulic actuator 48 is energized to push the doors 44, 45 to the fully open and retracted position. It is important in the construction of the vessel 10 to provide a sufficient recess for the bulkheads 44 and 45 in the open position so that the vertical clearance at the bow is no less than the vertical clearance present inside the holds 20 and 21 during the loading and unloading operation. Of course, if only one of the bow gates 35a or 35b is opened, only the corresponding hinged collision bulkhead 44 or 45 will also be opened. This situation may obtain in case loading and unloading is to occur only in one hold 20 or 21.

After the bow gates 35a and 35b are opened and the bulkheads 44 and 45 are in the retracted open position, as shown in FIG. 4, the barge tender 23 is demounted from the deck of the vessel, or another port tugboat comes alongside the vessel 10. The locking members 25 and 26, if present and in use, are slowly released, and the cargo carriers 22 then raise by freely floating in the holds 20 and 21 to the normal draft they occupy in accordance with the various loads they carry. It is important to allow the carriers 22 to raise fairly slowly to minimize the inflow of water displaced thereby through the now-open bow 16. Once the carriers 22 have achieved their normal drafts, they may be hooked in tandem within each hold, and the tender 23 connected to pull each line separately from each hold 20 and 21. Normally, the tender 23 withdraws the carriers 22 from one hold and then from the other.

New carriers 22 may be loaded in tandem into each hold 20 and 21 by the tender 23. The locking mechanisms 25 and 26, if used, are selected and positioned in accordance with the type of carrier 22 being loaded, whether it be a flat-bottomed barge, or LASH-type carrier, or any other floating cargo container suitable for use with the vessels described herein. The locking members, if used, are then clamped to the barge carriers 22 and are then actuated to pull the carriers 22 downwardly into their final resting position on the bottom of the hull structure 12. This action displaces a substantial quantity of water from the holds 20 and 21 out through the still-opened bow and reduces substantially the pumping time needed to dewater the holds 20 and 21. Of course, during this operation, the vessel 10c would be ballasted to a proper waterline level to enable the carriers 22 to be pulled downwardly to their resting position without becoming completely submerged.

After the carriers 22 are in place, the hinged collision bulkheads 44 and 45 are lowered to their closed positions against the stops 49 and then sealed by the locking action of the locking members entering their receptacles 53 and 54 in response to the driving force transmitted from the cylinders 56 to the linking bars 55. Then the hinged bow gates 35a and 35b are closed. At this point, those vessels such as the vessel 10c illustrated in FIGS.

11 and 12, which operate normally dry, would have their holds 20 and 21 pumped dry by actuation of the ballasting pumps 81 and 82 and opening of the valves 94. Water would flow into the sumps 91 and 92 in the holds 20 and 21, respectively, and thence through piping 93 into the headers 89 and 90. The pumps would discharge the pumped water through the sea chest 75 into the ocean. At the same time, ballasting operations would be underway. At this point the vessel would be in condition to begin its journey, or if desired or required by operating rules, the vessel might stand in the water until the holds 20 and 21 are substantially purged of water. After the journey, the operation described above would be repeated and the carriers 22 loaded and unloaded. It is to be understood, of course, that during the loading and unloading of the holds 20 and 21 the deck cargo containers 18 could be loaded and unloaded providing the vessel 10 were at anchor or at wharfside and a suitable crane, either on the vessel 10 or on the wharf were available for this operation.

FIG. 16 illustrates an operation variation of a normally dry hold vessel, such as the vessel 10c which has already been discussed in detail. The vessel 10c shown in FIG. 16 has been ballasted with its stern 15 low in the water and its bow 16 completely above the waterline with the hinged bow gate assembly 35 and bulkhead system 43 in the raised back, open position. A ramp 100 is emplaced between the floor surface of the fixed bottom structure 12 at the bow end 16 and an adjacent loading pier 101. The ramp 100 enables roll-on/roll-off cargo carrier vehicles 102 to be loaded to and from the barge holds 20 and 21. In the case of wheel mounted rolling containers 102 it will be appreciated that the holds 20 and 21 will be dept dry or substantially dry at all times that such containers 102 are carried therein.

Figure 7:
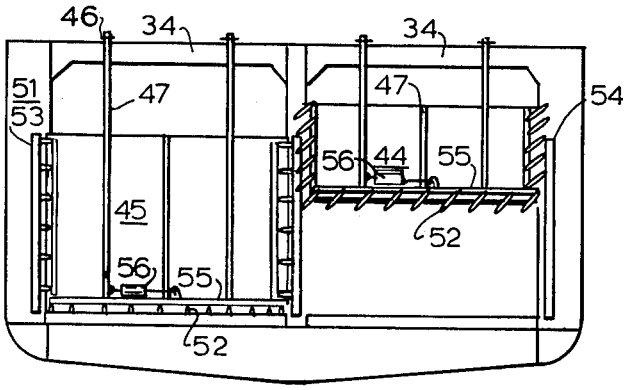
FIG. 7 is a view in section taken along the line 7—7 in FIG. 2, showing the port hold hinged collision bulkhead partly lifted upwardly and the starboard hold hinged collision bulkhead in the closed and sealed position.

Advantageously, in double hold vessels, such as the vessel 10c shown in FIG. 16, it is entirely practicable to carry rolling containers 102 in one hold 21 and barges 22 in the other hold 20, should the occasion arise. In these circumstances, the vessel 10c would be ballasted to the position relative to the waterline as illustrated in FIG. 16 for loading and unloading of the rolling containers 102 from the hold 20 via the ramp 100 and pier 101. Then the hinged bulkhead 45 would be closed and locked, as shown in FIG. 7. The ballast of the vessel 10c would then be changed to right the vessel in the water as shown in FIG. 4. Thereupon the hinged bulkhead 44 closing the port hold 20 would be raised to its open position (with the starboard hold bulkhead 45 remaining closed and watersealed). Barges 22 would then be floated in and out of the port hold 20 as illustrated in FIG. 4. The order of loading of the rolling stock 102 relative to the floating containers 22 is unimportant as long as the hold 21 containing the rolling stock is kept dry at all times. In some operational situations only rolling stock may be loaded and unloaded at a port of call of the vessel 10c while at other ports, loading of barges and other floating carriers 22 will be by flotation in and out of the partially submerged hold 20.

Referring now to FIG. 17, an important structural feature of vessels which embody the principles of the present invention, is the absence of any hatches or other openings in the deck thereof. The deck is also free of sheer, i.e., no curvature of the deck from fore to aft, and camber, i.e., round of beam, so that for all practical purposes it is substantially flat.

The section of flat deck 17 illustrated in FIG. 17 shows that the deck not only provides the vessel 10 with a highly suitable and stable loading platform for deck cargo containers 18, as shown in FIGS. 1–3, it also provides a structural element which is extraordinarily strong yet enables a highly efficient distribution of surface material, i.e., deck plate 140 and deck girders 141, 142, 143, and 144. Outside girders 141 are of greatest transverse width and may be integrally part of the sidewalls 13 and 14 of the vessel 10.

Inside of the largest girders 141 and running parallel from fore to aft are two girders 142 of next greatest transverse width. These girders 142 may be integrally a part of the inside walls of the sidewall structure, the thickness of which defines the location and, in part, the volume of the sidewall ballast tanks 30 and 31 (see FIG. 3).

Between the girders 141 and 142, which are substantially flat plates are several much smaller L-shaped girders 143 which are secured to the deck plate 140, for example, by continuously welded seams. Each of the L-shaped girders 143 is paralleled with, and spaced from, the other L-shaped girder 143. A pair of centrally positioned girders 144, of the same general geometry as the girders 142, may form an integral upper part of the longitudinal bulkhead 24 of the vessel 10. In a three-hold vessel, such as the vessel 110 shown in FIGS. 13–15, there would be a pair of girders 144 for each of the longitudinal bulkheads 125 and 126.

Periodically along the length of the vessel 10 cross members 145 are joined to the girders 141, 142, 143, and 144. An example of a cross member 145 is shown in FIG. 3. The girders 141, 142, 143, 144 and the cross members 145 provide the vessel 10 with a deck supporting structure 34 of extra-ordinary strength via an optimized minimum of structural material.

As already mentioned it is expected that some types of barges 22 will be flotation loaded into the vessel 10 and held in place longitudinally solely by the friction forces of the bottom surfaces of the barges in contact with the upper surface of the bottom structure 12. In this utilization the hold down devices 25, 26 would not be deployed, and would likely be entirely omitted in some vessels.

While the friction forces would be great enough to keep the barges 22 from sliding fore and aft as the vessel 10 pitches, in vessels having holds wider than the beam of the barges, these frictional forces might not be sufficient to secure the barges against sliding sideways as the vessel 10 rolls in heavy seas. To lock the barges 22 in place and prevent sideways sliding thereof, the vessel 10 may be provided with series of locking arms 180, shown in FIGS. 18, 19, and 20.

The arms 180 extend from series of recesses 181 and 182 provided respectively in the interiors of the port and starboard side structures 13 and 14 at locations even with the upper surface of the bottom structure 12. The arms 180 are pivotally mounted in the recesses 181 and 182 within a U-shaped hinge 183 so that the arms 180 may be pivoted from a vertical, stowed position, shown by broken lines in FIG. 20, to a horizontal, locking position.

Each arm 180 is provided with a curved abutment head 184 for engaging the outside sidewall structure of a barge 22 thereby urging the barge 22, and effectively locking it, against the central longitudinal bulkhead 24.

As shown in FIG. 19, the arm 180 is pivoted at a location off center, so that it will pivot to the horizontal operating position by its own weight. An eye shackle 185, mounted to each arm 180 adjacently inward of the abutment head 184 receives a retrieving line 186 threaded around a pulley 187 in an upper location in the recess 181 and extending to a winch 188 mounted on deck. An unobstructed passage tube 189 is provided in the sidewalls 13 and 14 for each locking arm 180 to accommodate barges having different beam dimensions.

In some instances the barges 22 may have a beam substantially the same as the width of the hold 20, 21, and in this situation the arms 180 would not be needed to hold the barges in place against sideways movement. FIG. 3 illustrates an inwardly slanting contour at the base of each interior sidewall structure 13 and 14 adjacent the upper surface of the bottom structure 12. These sloping contours 191 and 192 effectively wedge such barges 22 in place against the longitudinal central bulkhead 24.

A larger vessel 110 constructed in accordance with the principles of the present invention is illustrated in FIGS. 13–15. The vessel 110 includes a hull 111 and a bottom structure 112. The vessel 110 has a port side wall structure 113, a starboard side wall structure 114, a stern structure 115, and a bow structure 116. The vessel 11 includes a deck 117 which may be strengthened and outfitted to support and handle deck cargo containers 118. The vessel 110 has a superstructure 119 for the smokestack, pilot house, crew's quarters, galley, etc. A port engine room 120 having an engine pumping machinery, and a starboard engine pumping room 121 having like machinery are included within the hull 111.

The vessel 110 includes three longitudinal holds, a port hold 122, a center hold 123, and a starboard hold 124. These holds are separated by longitudinal bulkheads, a port side longitudinal bulkhead 125 and a starboard side bulkhead 126. The bulkheads 125 and 126 include vertical openings 127 and 128, respectively. These openings are sized to enable the movement of floating cargo containers 129 laterally into the port hold 122 and into the starboard hold 124 from the center hold 123. The center hold 123 is the hold through which the barges and containers 129 initially enter the vessel 110 in the manner to be described hereinafter.

The containers 129 illustrated in FIGS. 12, 13, and 14 are flat-bottomed river barges having no special reinforcing structure or special provision for use in conjunction with the vessel 110. The containers 129 could be LASH barges, or other forms of barges, and the illustration of the river barges is made to show that the principles of the present invention apply to a wide variety of different types and styles of floatable cargo containers.

To accommodate the river barges 129 in the holds 122, 123, and 124, the hold-down devices, if present at all, are somewhat different than those illustrated in connection with the vessel described in FIGS. 1 through 6. In the ship 110, the hold-down devices 130 and 131 have wide clamping members to engage a substantial surface of the port and starboard edges of each barge 129. Thus, the forces exerted by the hold-down devices 130 and 131 in pulling the barges 129 downwardly to their resting place on the bottom of the bottom 112 of the vessel 110, as shown in FIG. 13, are distributed evenly throughout the barges 129 and thereby minimize any possible damage or buckling that may occur were the forces to be concentrated. The hold-down devices are basically of two types: single hold-down devices 130, which are typically mounted in the port side 113 and in the starboard side 114, and at some locations in the longitudinal bulkheads 125 and 126, and double hold-down devices 131, which are mounted within the longitudinal bulkheads 125 and 126 and have clamping members extending into adjacent holds.

The vessel 110 includes a ballasting system to enable the vessel to be submerged to an appropriate loading and unloading level as illustrated in FIG. 14. The ballasting system includes pumping machinery (not shown) in the engine rooms 120 and 121, port side wall ballast tanks 132, starboard ballast tanks 133, and bottom structure ballast tanks 134. Piping similar to that shown in FIG. 10 would be included to flow seawater ballast to and from the tanks 132, 133, and 134. The vessel 110 would also include piping and valve structure of the types illustrated in FIGS. 7, 9, or 10 for flooding and dewatering the holds 122, 123, and 124 to enable loading and discharge of the barges 129 in the manner previously described.

The vessel 110 is outfitted with a hinged bow gate 150 which is hinged to the deck 117 by hinges 151. A bow-gate-lifting mechanism 152 enables the bow gate 150 to be elevated to provide access to the center hold 123. As shown in FIGS. 12 and 13, the hinged bow gate 150 is the central segment of the bow structure 116. The gate 150 is of sufficient width to provide unhindered access to the center hold 123, but it is not much wider. As with the vessel 10 described in FIGS. 1–6, the vessel 110 includes a hinged collision bulkhead 160 which is hinged to the deck structure 117 at hinges 161. A powering mechanism such as a hydraulic cylinder 162 enables the hinged collision bulkhead to be elevated to a fully retracted position above the ceiling level of the deck structure 117 to enable the barges to be loaded and unloaded through the bow 116.

The bow gate 150 and the hinged collision bulkhead 160 are provided with suitable locking mechanisms, which may be of the types illustrated and discussed in connection with FIG. 5. The hinged collision bulkhead 160 is outfitted with a sealing gasket to achieve a watertight seal for the hold 123. Also, the bulkhead 160 guards the hold 123 against the possibility of a collision. The holds 122 and 124 are provided with permanent fixed collision bulkheads 163 and 164, which are constructed in accordance with well-known conventional principles for fixed collision bulkheads in ocean-going vessels and which also seal the holds 122 and 124 against the entry of water at those locations.

The vessel 110 may be fitted with a hinged stern gate 170. As shown in FIGS. 12 and 13, the gate 170 closes the center hold 123 at the stern. The gate 170 is hinged to the deck 117 by hinges 171. A powered lifting mechanism 172 such as a hydraulic cylinder is connected to the deck structure 117 and to the gate 170 to enable it to be raised to an open position as shown in FIG. 14. The gate 170 may be provided with suitable locking machinery and a seal to achieve a watertight seal at the stern. Alternatively, a hinged bulkhead 173 adjacently ahead of the stern gate 170 may be provided to seal the hold 123. Such a bulkhead 173 would preferably have hinges 174 and an actuator 175, to operate similarly to the operation of the collision bulkhead 160. A rear bulkhead, not being a collision bulkhead, can be of much lighter construction than the bulkhead 160 but follows the same principles of design and operation.

The vessel 110 is operated substantially in the same manner as is the vessel 10 heretofore described in connection with FIGS. 1 through 11. Upon arriving at port or at another point of loading and unloading, the vessel 110, having barges 129 in its holds 122, 123, and 124, is ballasted to a suitable submerged level, and water is admitted to the holds 122, 123, and 124. When the water line in the holds equals the waterline of the sea, the bow gate 150 is raised and the hinged collision bulkhead 160 is unlocked, unsealed and lifted to its retracted position. Alternatively, or simultaneously as desired, the hinged stern gate 170 is unsealed and elevated by actuation of the lifting mechanism 172, and the bulkhead 173 raised by its lifting mechanism 175. Seawater is then free to communicate through the hold 123.

If the passageways 127 and 128 are always open, then the seawater passes into the holds 122 and 124 as well. Under some circumstances it may be desirable to provide sealing doors in bulkheads to close the openings 127 and 128 to enable one or more of the holds 122, 123, or 124 to be operated in a dry state and the other holds to be operated in a flooded state. Assuming cargo carriers 129 are to be moved into or out of the holds 122 and 124, the passageways 127 and 128 are opened at this time.

The hold-down devices 130 and 131, if present and being used, are then actuated to allow the carriers 129 to float slowly upwardly to their normal draft in the water. The hold-down members 130 and 131 are then disengaged from the barges 129, and the barges 129 are then free to be floated out of the center hold 123. They may be pushed out by a barge tender entering through the stern gate 170, or they may be pulled out by connection of the barges in tandem and to a barge tender at the bow. In any event, unloading of the center hold 123 is the first unloading operation. To unload the holds 122 and 124, the locking mechanisms 131*a* which are in the passageways 127 and 128, are completely retracted to physically removed. Then the passageways 127 and 128 are unobstructed, and barges may be laterally moved through the openings 127 or 128 into the center hold 123. Thereupon, they are withdrawn from the center hold 123 in the manner previously described. Alternatively, the vessel 110 may be fitted with locking arms 180 as shown in FIGS. 18, 19 and 20 and already disclosed in connection therewith.

Loading of the vessel 110 is in accordance with the reverse of the procedure outlined above. Containers are pushed or pulled into the center hold 123. They are then laterally moved through the passages 127 and 128 into the side holds 122 and 124. Finally, the center hold 123 is loaded, the locking mechanisms 130 and 131 (if present and to be used) are engaged, and the barges are pulled downwardly to their stowed position on the bottom of the bottom structure 112 of the vessel 110. This action displaced a substantial quantity of water from the holds 122, 123 and 124, and in the event that the vessel is to be operated with dry holds, substantially shortens pumping time required to complete the dryout of the holds.

The stern gate 170 is then lowered into its closed position and sealed, the hinged collision bulkhead 160 is lowered into its closed position and sealed, and the bow gate 150 is lowered to its normal operating position.

Pumps in the engine rooms 120 and 121 are then connected to complete the pumping operation of the holds 122, 123, and 124. As explained above, if one of the holds 122, 123, or 124 is operated in the flooded state, closing bulkhead doors would be in place in the passageways 127 or 128, as the case may be. These passageways would then be sealed, and the selected hold or holds maintained in a flooded state, whereas the other holds were pumped dry. At the same time, deballasting operations would be underway with sea water pumped out of the ballast tanks 132, 133, and 134. When deballasting of the ballast tanks and dewatering of the holds is completed, the vessel then would be in condition to begin its voyage.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. A barge-carrying waterborne vessel including in combination:

a hull with rigid supporting and hull-reinforcing structure, a bow, a stern, and side walls providing a series of buoyancy compartments, said hull having a hollow interior defining at least one hold extending most of the length of said vessel and having a bottom, hold-flooding means for enabling passage of water from the sea into said hold, pumping means for pumping water from said hold to dry out said hold, upwardly-opening gate means at the bow end of said vessel for flotation loading of said hold when said hold is partially flooded, with a plurality of buoyant cargo carriers such as barges, lighters and pontoons placed by flotation loading through said gate means into predetermined locations within said hold, collision bulkhead means located adjacent said gate for closing said hold off in a watertight manner, said collision bulkhead means being pivoted at its upper end, opening and closing means for moving said collision bulkhead means upwardly about its pivot so as to enable said flotation loading and unloading of said vessel, and hold-down means for holding each said carrier down against the bottom of said hold to prevent movement thereof and to enable exchange of buoyancy between said carrier and said vessel when water is in said hold.

2. The barge-carrying waterborne vessel of claim 1, having a rigid flat deck uninterrupted by hatches and other openings overlying said hold and strengthening said hull.

3. A barge-carrying waterborne vessel including in combination:

a hull with rigid supporting and hull-reinforcing structure, a cargo-carrying deck, an upwardly swingable bow, a stern, and side walls providing a series of buoyancy compartments, said hull having a hollow interior below said deck defining at least one hold extending most of the length of said vessel and having a bottom, pumping means for changing the amount of water in each said buoyancy compartment, for placing seawater into said hold and for removing the water from said hold, gating means for swinging upwardly to open said bow, for closing it in a normal voyaging position and for opening it for flotation loading of said hold, said hold then being partially flooded, with a plurality of buoyant cargo carriers such as barges, lighters and pontoons placed by the flotation loading into predetermined locations within said hold, pivoted collision bulkhead means aft of said bow for closing said hold off in a watertight manner and for swinging upwardly to open said hold, means for swinging said collision bulkhead means upwardly so as to enable said flotation loading and unloading of said vessel, and positioning means for holding each said carrier down against the bottom of said hold to prevent movement thereof and to enable exchange of buoyancy between said carrier and said vessel when water is in said hold.

4. A barge-carrying waterborne vessel including in combination:

a hull with rigid supporting and hull-reinforcing structure, a deck, a bow, a stern, and side walls providing a series of buoyancy compartments, said hull having a hollow interior defining at least one hold extending most of the length of said vessel and having a bottom, a series of openings through said side walls into said hold for enabling passage of water from the sea into said hold, a valve at each opening for closing it off when desired, valve control means on said deck connected to said valve for opening and closing each said valve, pumping means for pumping water from said hold to dry out said hold, gating means for opening said bow to enable flotation loading of said hold, when said hold is partially flooded, with a plurality of buoyant cargo carriers such as barges, lighters and pontoons placed by flotation loading through said bow into predetermined locations with said hold, collision bulkhead means aft of said bow, for closing said hold off in a watertight manner, means for moving said collision bulkhead means so as to enable said flotation loading and unloading of said vessel, and carrier retention means for holding each said carrier down against the bottom of said hold to prevent movement thereof and to enable exchange of buoyancy between said carrier and said vessel when water is in said hold.

5. An oceangoing merchant vessel for carrying buoyant cargo containers in a hold thereof, said vessel comprising the combination of:

a hull shell having reinforcing and supporting structure, a bow and a stern, said hull shell having a series of buoyancy compartments in side wall structure thereof and a hollow interior defining at least one hold extending from the bow to the stern with a bottom for carrying said buoyant cargo containers thereon, ballast varying means for varying the ballasting in said buoyancy compartments and thereby the waterline of said vessel between a loading position and a cruising position, hold flooding means for flooding said hold with seawater to float said containers, when said vessel is ballasted to its said loading position, hold dewatering means for purging said hold of floodwaters, an openable closure in the stern for opening said hold from the hold bottom to a ceiling thereof to enable thereby the flotation movement in tandem of a plurality of said buoyant cargo containers into and out of said hold, said openable closure opening by swinging upwardly and including sealing means for sealing said hold against intrusion of seawater when said closure closes said hold and powering means for moving said closure between a closed and an open position, and a plurality of spaced apart hold-down means in said hold for engaging each buoyant cargo container floating in said hold and for pulling said container to its resting position on the bottom of said hold, to enable exchange of buoyancy between said container and said vessel when water is in said hold.

6. The vessel of claim 5 having a rigid flat deck uninterrupted by hatches and other openings overlying said hold and strengthening said hull.

7. An oceangoing merchant vessel for carrying buoyant cargo containers in a hold thereof, said vessel comprising the combination of:

a hull shell having reinforcing and supporting structure, a bow and a stern, said hull shell having a series of buoyancy compartments in side wall structure thereof and a hollow interior defining two immediately adjacent holds, each extending from the bow to the stern with a bottom for carrying said buoyant cargo containers thereon, a longitudinal bulkhead in said hollow interior separating one hold from the other and restraining floodwaters in one hold from passing into said other hold during cruising operations of said vessel, ballast varying means for varying the ballasting in said buoyancy compartments and thereby the waterline of said vessel between a loading position and a cruising position, hold flooding means for flooding said holds with seawater to float said containers, when said vessel is ballasted to its said loading position, hold dewatering means for purging said holds of floodwaters, two separately openable upwardly swinging closures in at least one of the bow and stern for opening each said hold from the hold bottom to a ceiling thereof to enable thereby the flotation movement in tandem of a plurality of said buoyant cargo containers into and out of said hold, said openable closure including sealing means for sealing said hold against intrusion of seawater when said closure closes said hold and powering means for moving said closure between a closed and an open position, and a plurality of spaced apart hold-down means in each said hold for engaging each buoyant cargo container floating in said hold and for pulling said container to its resting position on the bottom of said hold.

8. An oceangoing merchant vessel for carrying buoyant cargo containers in a hold thereof, said vessel comprising the combination of:

a hull shell having reinforcing and supporting structure, a bow and a stern, said hull shell having a series of buoyancy compartments in side wall structure thereof and a hollow interior defining at least three adjacent longitudinal holds separated by plural longitudinal bulkheads, extending from the bow to the stern with a bottom for carrying said buoyant cargo containers thereon, ballast varying means for varying the ballasting in said buoyancy compartments and thereby the waterline of said vessel between a loading position and a cruising position, hold flooding means for flooding said holds with seawater to float said containers, when said vessel is ballasted to its said loading position, hold dewatering means for purging said holds of floodwaters, an openable closure at one end of said vessel for a first of said holds so that said first hold is openable to the sea by said openable closure from the hold bottom to a ceiling thereof to enable thereby the flotation movement in tandem of a plurality of said buoyant cargo containers into and out of said first hold, said openable closure including sealing means for sealing said hold against intrusion of seawater when said closure closes said hold and powering means for moving said closure between a closed and an open position.

said longitudinal bulkheads defining passageways enabling flotation passage therethrough of said carriers from said first hold into second and third holds, and a plurality of spaced apart hold-down means in said hold for engaging each buoyant cargo container floating in said hold and for pulling said container to its resting position on the bottom of said hold.

9. The vessel in accordance with claim 8 wherein said first hold is provided with a said closure at said stern, and a said closure at said bow comprising a movable collision bulkhead at said bow and further comprising powered hinged gate means at said bow for opening said bow for flotation loading of said containers therethrough when said vessel is in its loading position.

10. A method for transporting a plurality of buoyant cargo carriers, such as barges, lighters, and pontoons, in the sea, employing a waterborne vessel of adjustable buoyancy having at least one floodable hold for said carriers and gate means in at least one end for opening and for closing said end of said hold and an operable movable collision bulkhead adjacent said gate means, comprising:

opening said gate means upwardly while there is water in said hold, opening said collision bulkhead upwardly, floating a series of said containers into said hold, forcing all said containers down against the bottom of said hold to hold them there in a stable position and also to displace and thereby purge water from said hold out of said hold through said gate means, closing said collision bulkhead in a watertight closure that seals off said hold, closing said gate means, pumping substantially all said water from said hold while adjusting the buoyancy of said vessel, voyaging with said vessel across the sea to a desired location, transferring water from the sea into said hold while adjusting the buoyancy of the vessel to approximately place the water in said hold at the same level as the sea, opening said gate means upwardly, opening said collision bulkhead upwardly, floating out some of said containers, and then reloading as described in said floating-in step through said pumping step, and continuing the voyage.

11. A method for transporting a plurality of buoyant cargo carriers, such as barges, lighters, and pontoons, in the sea, employing an adjustably buoyant waterborne vessel having a plurality of floodable holds for carrying said carriers therewithin and gate means for opening and for closing and sealing one end of at least one of said holds, comprising:

opening said gate means while there is water in said hold, floating a series of said containers into said holds, forcing all said containers down against the bottom of said holds to hold them there in a stable position and also to displace and thereby purge water from said holds out through said gate means, and also to enable exchange of buoyancy between said containers and said vessel when water is in said hold, closing and sealing said gate means, pumping substantially all said water from at least one of said holds while adjusting the buoyancy of said vessel, voyaging with said vessel across the sea to a desired location, transferring water from the sea into said holds while adjusting the buoyancy of the vessel to approximately place the water in said hold at the same level as the sea, opening said gate, and floating out some of said containers, and then reloading as described in said floating-in step through said pumping step and continuing the voyage.

12. A method for transporting by sea a different types of cargo, one floatable on water and one rollable and to be kept dry, employing an adjustably buoyant waterborne vessel having a plurality of holds for carrying said cargo therewithin, said holds extending most of the length of said vessel and having a bottom lying below the vessel's waterline when the vessel is trimmed and ballasted for seagoing operations, loading gate means located at one end of each said hold for opening during loading and for closing and sealing during seagoing operations, comprising the steps of:

(A) loading and unloading one hold with said rollable cargo, by (1) ballasting said vessel in the water so that the end thereof having said gate means is completely above the surface of the water, (2) then opening said gate means, (3) providing loading ramp means connecting the bottom of said hold at said gate means to an adjacent loading pier, (4) rolling said rollable cargo from and to said hold via said ramp and through said opened gate means, (5) disconnecting said ramp means when loading is complete, (6) then closing said gate means, and (7) in preparation for seagoing operations, ballasting said vessel to a righted, operational position for the voyage, and (B) loading and unloading one said hold with said floatable cargo, by (1) ballasting said vessel in the water so that the end thereof having said gate means is sufficiently below the surface of the water to enable flotation loading and unloading, (2) flooding said hold so that floatable cargo can be floated into said hold, (3) opening said gate means, (4) floating said floatable cargo from and to said hold through said opened gate means, (5) closing said gate means, (6) drying said hold, and (7) in preparation for seagoing operations, ballasting said vessel to its operational position for the voyage.

* * * * *

UNITED STATES PATENT AND TRADEMARK OFFICE

CERTIFICATE OF CORRECTION

PATENT NO. : 4,135,468

DATED : January 23, 1979

INVENTOR(S) : William E. Kirby & David J. Seymour

It is certified that error appears in the above-identified patent and that said Letters Patent are hereby corrected as shown below:

Left-hand column of cover page, delete the item "[30] Foreign Application Priority Data" in its entirety.

Item [56] of left-hand column of cover page, the numbers "144/78" after "Laskey et al" should read --114/78--; and the number "3,939,760" of the Varges et al patent should read --3,939,790--.

Column 6, line 47, "bulkhead" should read --bulkheads--.
Column 11, line 34, "dept" should read --kept--.
Column 13, line 23, "11 includes" should read --110 includes--.
Column 15, line 34, "retracted to" should read --retracted or--.
Column 20, line 25, which is line 1 of claim 12, "a different types" should read --two types--.
Column 20, line 53, which is line 30 of claim 12, "(B) loading and unloading one said hold" should read --(B) loading and unloading a different said hold--.

Signed and Sealed this

First Day of May 1979

[SEAL]

Attest:

RUTH C. MASON
*Attesting Officer*

DONALD W. BANNER
*Commissioner of Patents and Trademarks*